United States Patent [19]

Ellis

[11] Patent Number: 4,679,742

[45] Date of Patent: Jul. 14, 1987

[54] CRUSHER HAVING OPPOSED AND BALANCED DRIVER JAWS

[75] Inventor: Leslie G. Ellis, Christchurch, New Zealand

[73] Assignee: Ian Gordon Rodger, Christchurch, New Zealand

[21] Appl. No.: 799,301

[22] Filed: Nov. 18, 1985

[51] Int. Cl.[4] ..... B02C 1/06

[52] U.S. Cl. ..... 241/266; 241/267; 241/300

[58] Field of Search ..... 241/264–269, 241/300

[56] References Cited

U.S. PATENT DOCUMENTS

| | | | |
|---|---|---|---|
| 427,441 | 5/1890 | Roth | 241/265 |
| 472,367 | 4/1892 | Kaapp | 241/264 |
| 2,326,215 | 8/1943 | Gruender | 241/267 X |
| 3,079,096 | 2/1963 | McConnell | 241/266 X |
| 4,124,170 | 11/1978 | Braun et al. | 241/265 |

*Primary Examiner*—Timothy V. Eley

*Attorney, Agent, or Firm*—Ross, Ross & Flavin

[57] ABSTRACT

A crusher, for example for rock or the like, has crushing jaws which are driven to swing towards and away from each other and are pivoted to a frame adjacent the ends of the jaws, so that most of the jaw movement is in a horizontal direction and is therefore a substantially balanced assembly.

17 Claims, 4 Drawing Figures

CRUSHER HAVING OPPOSED AND BALANCED DRIVER JAWS

BACKGROUND OF THE INVENTION (a) Field of the Invention

This invention relates to crushing apparatus.

The apparatus of the present invention is useful for crushing rock, and will be described with particular reference to this application. However, the apparatus also is useful for crushing other materials (e.g. glass, minerals, bricks, grains).

(b) Background of the Invention

Crushing at present is carried out in a number of types of apparatus:- ball mills, rod mills, hammer mills and jaw crushers. However, for 'accurate' crushing i.e. crushing material to obtain particles within a narrow size range, and with relatively few fines, a jaw crusher commonly is used. A jaw crusher crushes by a hammer-and-anvil type of action: a moving jaw is swung against a stationary jaw. The position of the stationary jaw can be adjusted to alter the minimum gap between the jaws. This type of crusher gives good results, but is rather wasteful of power because a great deal of the force of the moving jaw is absorbed by the stationary jaw rather than by the material being crushed. In consequence, the apparatus requires a heavy support, to endure the uneven load on the apparatus imposed by the impacts on the stationary jaw. Such a jaw crusher is shown and described in Australian Pat. No. 227301.

BRIEF SUMMARY OF THE INVENTION

An object of the present invention is the provision of a crusher which is as accurate as a stationary jaw crusher, but which overcomes the above-described disadvantages by providing opposed driven jaws which balance each other to a large extent.

A further object of this invention is to provide a crusher which is simple and inexpensive to manufacture and repair, and which is adjustable so that the rock may be crushed to a greater or lesser degree.

According to this invention, there are provided a pair of opposed crushing jaws with a pivotal mounting of each jaw for allowing pivotal movement toward and away from the other jaw, a means for driving the jaws to pivot toward each other simultaneously and away from each other simultaneously, with the pivotal mounting of each jaw being adjacent one end of the jaw. The said one ends of the jaws are located opposite each other, and the other ends of the jaws are located opposite each other. A drive shaft is rotatably mounted on one of the jaws. The drive shaft is formed with an eccentric portion. A connecting rod is pivoted at one end on the eccentric portion and at the other end to the other jaw and is also pivoted to the drive shaft and to the other jaw remote from the pivotal mountings of the jaws.

Preferably, means are provided for adjusting the minimum gap between the jaws when they are swung towards each other.

DETAILED DESCRIPTION OF THE PREFERRED EMBODIMENT

By way of example, a preferred embodiment of the present invention is described with reference to the accompanying drawings, in which.

Figure 1:
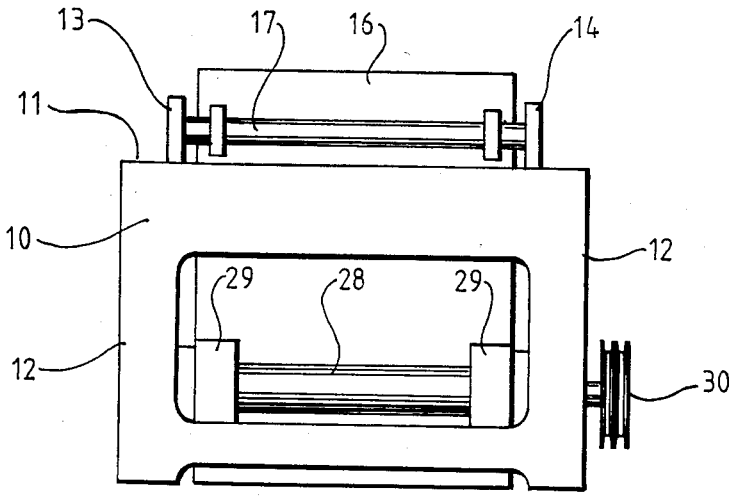
FIG. 1 is an end view of the apparatus of the present invention.
Figure 2:
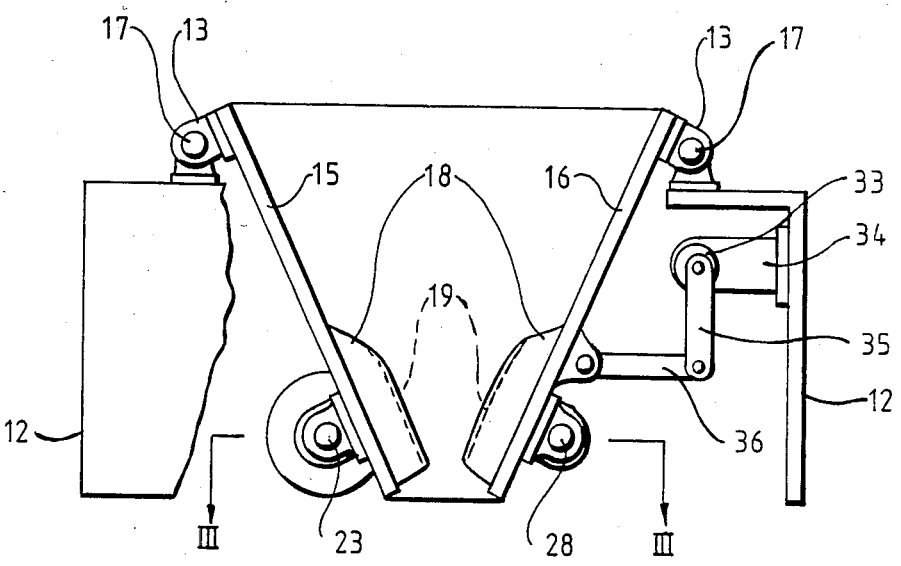
FIG. 2 is a side view of the apparatus of FIG. 1, with part of the frame member removed.
Figure 3:
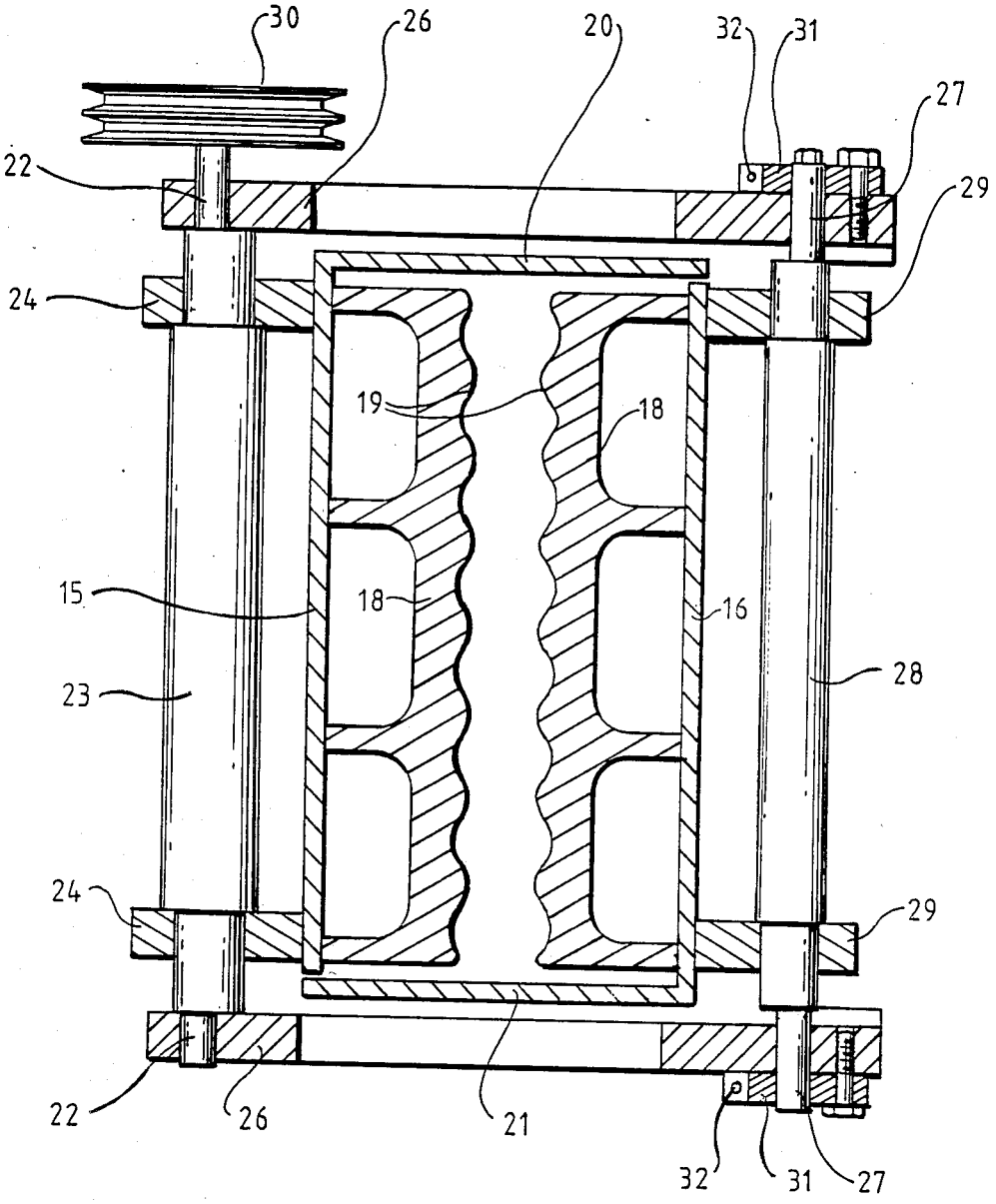
FIG. 3 is a section along the line III—III in FIG. 2.
Figure 4:
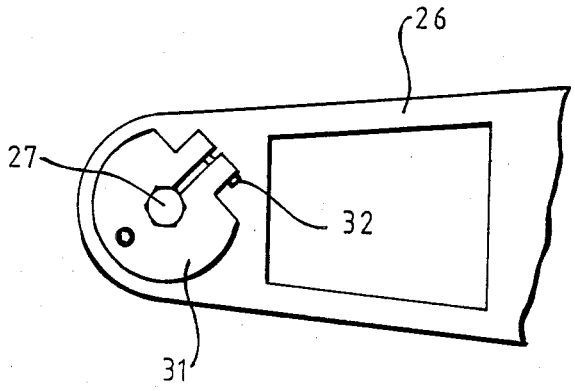
FIG. 4 is an end view of part of FIG. 3.

Referring to the drawings, a rock crushing apparatus comprises a frame 10 in the form of a table having a top 11 and legs 12. On the frame top 11 two pairs of crusher jaw pivot bearings 13,14 are provided. Both pairs of pivot bearings 13, 14 oppose each other across the top 11. Two jaws 15, 16 face each other, each jaw 15, 16 has a horizontal shaft 17 extending from each side of its upper end; the ends of each shaft 17 are pivotally secured in the pivot bearings 13, 14. The two jaws 15, 16 of the crusher are therefore suspended opposite each other from the top 11.

Preferably, the inner surfaces of the crusher jaws are protected by wearing blocks 18, made with a plurality of ribs 19 on their working surface. The ribs 19 may decrease in depth towards one end. The inner crushing surfaces of the blocks 18 may be lines with hard alloy steel to reduce wear. The jaws 15, 16 are spaced wider at the top than the bottom, and two vertical end walls 20, 21 are welded, one wall to each jaw and with the free end of each wall 20, 21 close to the adjacent end of the other jaw 15, 16. Thus jaw 15 and wall 20 move together and jaw 16 and wall 21 move together, the arrangement being such that a "V" shaped hopper is formed by the end walls and jaws. When the crusher is operating, material to be crushed is fed into the top of the hopper, falls under gravity through the crusher, and leaves the bottom of the crusher in its crushed condition.

The lower ends of the jaws 15, 16 are joined by a reciprocating mechanism which causes both the crusher jaws to swing simultaneously about their pivot bearings 13, 14. The reciprocating mechanism causes the jaws to come together at the same time and move apart at the same time; each jaw is moved with the same force. The reciprocating movement is provided by eccentrics 22 on a driving shaft 23, which is mounted horizontally in two bearings 24 on the outer surface at the lower end of the jaw 15. The driving shaft 23 extends beyond the width of the jaw 15 and two connecting rods 26 are mounted on the eccentrics 22. The other ends of the connecting rods 26 are mounted on similarly disposed eccentric journals 27 on a cross-shaft 28 which is mounted horizontally in bearings 29 at the lower end of the other jaw 16, parallel to the driving shaft 23 on the jaw 15.

A V-belt drive pulley 30 is secured to the end of the driving shaft 23, and this pulley 30 is driven from a motor (not shown) in known manner. When the pulley 30 is driven, it rotates the driving shaft 23, so that the eccentric journals on the shaft 23 cause the jaw 15 to swing towards and away from the jaw 16.

In normal operation, the connecting rods 26 do not move on the eccentrics 27 but are clamped to the shaft 28 by clamps 31 screwed to the connecting rods 26 and releaseable from the shaft 28 by screws 32. When the shaft 28 is unclamped it may be partially rotated in the connecting rods 26, whereby the eccentrics 27 adjust the distance between the axes of the shafts 23, 28 and thus enable the gap between the lower ends of the jaws 15, 16 to be altered. The clamps 31 are then re-tightened.

The distance between the upper ends of the jaws 15, 16 may be altered, independantly of the lower ends of the jaws, for example by unbolting the bearings 13, 14 from the top 11 and repositioning them using different (unshown) bolt holes in the top 11.

Instead of using the eccentrics 27, the distance between the bottom of the jaws 15, 16 can be changed by using connecting rods of adjustable length, for example in the form of a turnbuckle having right and left-hand threads.

The end walls 20, 21 could be welded to opposite ends of one jaw 15, 16 and have small gaps adjacent the ends of the other jaw 16, 15 but such an arrangement would destroy the balance and symmetry of the arrangement described above.

The wearing blocks 18 may be clamped, screwed or otherwise fastened to the jaws 15, 16 and may be invertable.

Although the jaws 15, 16 may swing together on the shafts 17 they are preferably centred by a spring, such as an elastomeric bush 33, fastened in a block 34 bolted to the legs 12. The bush inner is fastened to a torsion arm 35 which is connected by a pivoted link 36 to the jaw 16.

For some purposes it may be preferred to invert the arrangement shown in the drawings so that the hopper still tapers downwardly, but the upper ends of the jaws 15, 16 are driven and the lower ends thereof are pivoted.

By pivoting the jaw assemblies to the frame 10 near their ends, it will be seen that the centre of gravity of each jaw assembly has little vertical movement compared with the horizontal movement. Thus, there is little vertical vibrating force transmitted to the frame 10 and horizontal forces are largely balanced out.

I claim:

1. A crusher including: a pair of opposed crushing jaws, a pivotal mounting of each jaw for pivotal movement towards and away from the other jaw, means for driving the jaws to pivot towards each other simultaneously and away from each other simultaneously, the pivotal mounting of each jaw being adjacent one end of the jaw, the said one ends of the jaws being located opposite each other, the other ends of the jaws being located opposite each other, a drive shaft rotatably mounted on one of the jaws and having eccentric portions, a cross shaft rotatably mounted on the other of the jaws and having eccentric portions, a pair of connecting rods each pivoted at one end on a respective eccentric portion of the drive shaft and pivoted at the opposite end on a respective eccentric portion of the cross shaft, and means for adjusting the distance between the pivots at the ends of the connecting rods.

2. The crusher as claimed in claim 1 wherein: means are provided for adjusting the minimum gap between the jaws when the jaws are swung towards each other.

3. The crusher as claimed in claim 2 in which: the pivotal mounting of one jaw is movable towards and away from the pivotal mounting of the other jaw.

4. The crusher as claimed in claim 1 in which: the means for adjusting the distance between the pivots includes a further shaft pivoted on the said other jaw parallel to the drive shaft, the said further shaft being formed with a further eccentric portion, the said other end of the connecting rod being rotatably on the further eccentric portion and clampable thereon whereby partial rotation of the further shaft within the connecting rod will adjust the distance between the pivots thereof.

5. A rock crushing apparatus comprising in combination a frame, two pairs of crusher jaw pivot bearings mounted on the frame, a pair of jaws, a pair of horizontal shafts each extending from side-to-side of and outboard of a respective jaw and being pivotally secured in the respective pair of crusher jaw pivot bearings for suspending the respective jaw in opposed relationship as to the other jaw, a reciprocating mechanism for the simultaneous swinging of the jaws with equal force toward each other and away from each other about the respective crusher jaw pivot bearings and including:

a. a horizontally-disposed driving shaft extending from side-to-side of and outboard of one of the jaws, b. a horizontally-disposed cross shaft extending from side-to-side of and outboard of the other of the jaws, c. a pair of bearings mounted on the said one of the jaws for the journalling of the driving shaft therein, d. a pair of bearings mounted on the said other of the jaws for the journalling of the cross shaft therein, e. a pair of driving shaft eccentrics on opposite ends of the driving shaft, f. a pair of cross shaft eccentrics on opposite ends of the cross shaft, g. a pair of connecting rods each being mounted at one of its ends on a respective one of the driving shaft eccentrics and at the opposite of its ends on a respective one of the cross shaft eccentrics, and h. drive means for driving the driving shaft, all adapted and arranged whereby rotation of the driving shaft and of the driving shaft eccentrics effects simultaneous swinging movements of the jaws toward and away from each other.

6. The crusher as claimed in claim 5 in which: the pivotal mountings of the jaws are adjacent the top thereof, and the means for driving the jaws is located at the lower half of the jaws.

7. The crusher as claimed in claim 5 in which: the jaws form facing walls of a downwardly convergent hopper.

8. The crusher as claimed in claim 7 wherein: said downwardly convergent hopper is provided with end walls, with one end wall at each end of the jaws.

9. The crusher as claimed in claim 8 wherein: one end wall is rigidly fastened to one end edge of one of the jaws and extends with a small clearance past the opposing end edge of the other jaw, and the other end wall is rigidly fastened to one end edge of the other jaw and extends with a small clearance past the opposing end edge of the said one jaw.

10. The crusher as claimed in claim 8 in which: both of the end walls are fastened rigidly to opposite end edges of the same jaw and extend with a small clearance past the opposing end edge of the other jaw.

11. The crusher as claimed in claim 5 in which: the jaws have opposing working faces which bear against material passing through the crusher in order to crush the material, and at least one of the working faces being formed with a plurality of parallel grooves extending towards the outlet for crushed material.

12. The crusher as claimed in claim 11 in which: the depth of said grooves decreases from one end of the grooves to the other end.

13. The crusher as claimed in claim 12 in which: the depth of the grooves decreases to zero adjacent the said other end of the grooves.

14. The crusher as claimed in claim 11 in which: at least one jaw includes a removable and replaceable wearing block on which said working face is formed.

15. The crusher as claimed in claim 14 in which: the wearing block is invertable relative to the rest of the jaw.

16. The crusher as claimed in claim 5 including: a spring acting on at least one of the jaws to bias the jaws to a centralised working position.

17. The crusher as claimed in claim 16 in which: the spring is an elastomeric torsion spring.

* * * * *